US011504991B2

(12) United States Patent
Poitevin et al.

(10) Patent No.: US 11,504,991 B2
(45) Date of Patent: Nov. 22, 2022

(54) INKLESS PRINTING ON SUBSTRATES AND COMESTIBLES

(71) Applicant: INTERCONTINENTAL GREAT BRANDS LLC, East Hanover, NJ (US)

(72) Inventors: Patrick Jules Joseph Poitevin, Derbyshire (GB); Stuart Mackintosh Blyth, York (GB)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 0 days.

(21) Appl. No.: 16/637,307

(22) PCT Filed: Aug. 13, 2018

(86) PCT No.: PCT/US2018/046459
§ 371 (c)(1),
(2) Date: Feb. 7, 2020

(87) PCT Pub. No.: WO2019/036345
PCT Pub. Date: Feb. 21, 2019

(65) Prior Publication Data

US 2020/0247167 A1 Aug. 6, 2020

Related U.S. Application Data

(60) Provisional application No. 62/545,217, filed on Aug. 14, 2017.

(51) Int. Cl.
*B41M 5/34* (2006.01)
*B41J 3/407* (2006.01)
(Continued)

(52) U.S. Cl.
CPC ..... *B41M 5/34* (2013.01); *B41J 3/4075* (2013.01); *G09F 3/0294* (2013.01); *G09F 3/0297* (2013.01); *G09F 2003/0202* (2013.01)

(58) Field of Classification Search
None
See application file for complete search history.

(56) References Cited

U.S. PATENT DOCUMENTS 4,188,437 A 2/1980 Rohowetz
7,546,923 B2 6/2009 Abergel
(Continued)

FOREIGN PATENT DOCUMENTS

CN 1723134 A 1/2006
CN 102428365 A 4/2012
(Continued)

OTHER PUBLICATIONS

International Search Report and Written Opinion; International Application No. PCT/US2018/046454; International Filing Date: Aug. 13, 2018; dated Feb. 11, 2019; 20 pages.
(Continued)

*Primary Examiner* — Erica S Lin
(74) *Attorney, Agent, or Firm* — Cantor Colburn LLP

(57) ABSTRACT

A method of marking a package (72) includes providing a package (72) including an additive transformable from a first state to a second state in response to an external stimulus and presenting said package via a sales device (80). At least a portion of said additive is in said first state when said package is presented in said sales device (80). At least a portion of said additive is activated to form identifying indicia on said package within said sales device (80).

8 Claims, 9 Drawing Sheets

(51) Int. Cl.
*G09F 3/00* (2006.01)
*G09F 3/02* (2006.01)

(56) References Cited

U.S. PATENT DOCUMENTS

| | | | | |
|---|---|---|---|---|
| 8,114,811 | B2 | 2/2012 | Denton et al. | |
| 2003/0082321 | A1 | 5/2003 | Kennedy et al. | |
| 2003/0103905 | A1 | 6/2003 | Ribi | |
| 2003/0200725 | A1 | 10/2003 | Aloisi et al. | |
| 2005/0194280 | A1* | 9/2005 | Smith | G09F 3/04 206/459.5 |
| 2006/0131402 | A1* | 6/2006 | Crockett | G07G 1/0054 235/383 |
| 2006/0157559 | A1* | 7/2006 | Levy | G06Q 20/40145 235/380 |
| 2012/0181453 | A1* | 7/2012 | Patel | G01T 1/06 250/473.1 |
| 2014/0006128 | A1* | 1/2014 | Grigg | G06Q 30/0253 705/14.23 |
| 2014/0127429 | A1 | 5/2014 | Jarvis et al. | |
| 2014/0288699 | A1* | 9/2014 | Williams | B29C 64/379 700/233 |
| 2016/0133078 | A1 | 5/2016 | Hussain et al. | |
| 2020/0232958 | A1 | 7/2020 | Zerfas et al. | |

FOREIGN PATENT DOCUMENTS

| | | | | |
|---|---|---|---|---|
| CN | 103781632 | A | 5/2014 | |
| CN | 204488141 | U | 7/2015 | |
| CN | 204526302 | U | 8/2015 | |
| CN | 105894303 | A | 8/2016 | |
| EP | 484578 | A * | 5/1992 | B65D 79/02 |
| EP | 2151323 | A1 | 2/2010 | |
| EP | 2678742 | A | 1/2014 | |
| JP | H04190493 | A | 7/1992 | |
| JP | 2004216740 | A | 8/2004 | |
| JP | 2005165647 | A | 6/2005 | |
| JP | 2005178871 | A | 7/2005 | |
| JP | 2005324813 | A | 11/2005 | |
| JP | 2006001206 | A | 1/2006 | |
| JP | 2006503771 | A | 2/2006 | |
| JP | 2007217048 | A | 8/2007 | |
| JP | 2007313875 | A | 12/2007 | |
| JP | 3148390 | U | 2/2009 | |
| JP | 2010076180 | A | 4/2010 | |
| JP | 2014000734 | A | 1/2014 | |
| JP | 2015066720 | A | 4/2015 | |
| JP | 2015123616 | A | 7/2015 | |
| JP | 2015127109 | A | 7/2015 | |
| JP | 2015189008 | A | 11/2015 | |
| JP | 2016093961 | A | 5/2016 | |
| WO | 1991019649 | A1 | 12/1991 | |
| WO | 0200920 | A2 | 1/2002 | |
| WO | 2002000920 | A2 | 1/2002 | |
| WO | 02099416 | A1 | 12/2002 | |
| WO | 2002099416 | A1 | 12/2002 | |
| WO | 2006010019 | A2 | 1/2006 | |
| WO | 2006069653 | A1 | 7/2006 | |
| WO | 2012114121 | A2 | 8/2012 | |
| WO | 2013049525 | A1 | 4/2013 | |
| WO | 2015148619 | A1 | 10/2015 | |

OTHER PUBLICATIONS

International Search Report; International Application No. PCT/US2018/046459; International Filing Date: Aug. 13, 2018; dated Oct. 25, 2018; 6 pages.

Written Opinion; International Application No. PCT/US2018?046459; International Filing Date: Aug. 13, 2018; dated Oct. 26, 2018; 8 pages.

Australian Office Action; International Application No. 2018318927; International Filing Date: Jan. 17, 2020; dated Jul. 15, 2020; 4 pages.

Examination Report No. 1; Australian Application No. 2018318930; International Filing Date: Mar. 4, 2020; dated Jan. 19, 2021; 4 pages.

Japanese Office Action; International Application No. 2020-502135; International Filing Date: Jan. 16, 2020; dated Feb. 2, 2021; 14 pages with translation.

Examination Report No. 2.; Australian Patent Application No. 2018318927; International Filing Date: Jan. 17, 2020; dated Dec. 11, 2020; 4 pages.

Japanese Office Action; International Application No. 2020-502989; International Filing Date: Jan. 21, 2020; dated Nov. 4, 2020; 3 pages.

Canadian Application No. 3070456 filed Aug. 13, 2018; Office Action dated Mar. 18, 2021; 7 pages.

First Examination Report; Indian Application No. 2202047003474; International Filing Date: Jan. 27, 2020; dated Mar. 26, 2021; 5 pages.

Japanese Patent Application No. 2020-502989; OA; Notice of Reasons for Refusal with English translation; dated May 14, 2021, pp. 1-11.

Stewart, R. et al.; "Selective decolorization of pigments within two and three pigmented inks for colored marking by a Q-switched laser"; Journal of Laser Application, vol. 15, No. 4; pp. 294-299; Nov. 15, 2003.

First Examination Report; Indian Application No. 202047003041; International Filing Date: Jan. 23, 2020; dated Mar. 1, 2021; 6 pages.

Notification of the First Office Action; Chinese Application No. 201880047564.7; International Filing Date: Jan. 16, 2021; dated Mar. 3, 2021; 13 pages.

Canadian Application No. 3070456 filed Aug. 13, 2018; Office Action (Requisition by Examiner) dated Aug. 24, 2021; pp. 1-8.

EP Application No. 18765515.4 filed Jan. 30, 2020; EP COmmunication Pursuant to Article 94(3) EPC (Examination Report) dated Sep. 29, 2021; pp. 1-6.

Notification of the First Office Action; Chinese Application No. 201880048083.8; International Filing Date: Jan. 16, 2020; dated Oct. 11, 2021; 6 pages.

Canadian Application No. 3070454 filed Jan. 17, 2020; Office Action (Requisition by the Examiner) dated Oct. 14, 2021; pp. 1-4.

Notification of Office Action—Reasons for Refusal w english translation; Japanese Application No. 2020-502135; International Filing Date: Jan. 16, 2020; dated Nov. 9, 2021; pp. 1-12.

Notification of the Second Office Action w English Translation; Chinese Application No. 201880047564.7; International Filing Date: Jan. 16, 2021; dated Nov. 3, 2021; pp. 1-14.

Notification of the First Office Action with English Translation; Chinese Application No. 201880048083.8; International Filing Date: Jan. 16, 2020; dated Oct. 11, 2021; 6 pages.

Guobin et al., "Packaging technology and equipment", JIN, China Light Industry Press, Section 4: Food packaging quality monitoring technology, pp. 74-76, Jan. 2009, Sep. 24, 2021. (Concise explanation of relevance is provided by the translated CN Office Action listed above #4 201880048083.8; dated Oct. 11, 2021).

Art Panorama Editorial Department, "The Chinese Fine Arts Education Academic Symposium—The Teaching Research Volume", Liaoning Fine Arts Publishing House,"Innovative ideas for humanized packaging design and teaching", p. 199, Oct. 2016, Sep. 15, 2021; 1-3. (Concise explanation of relevance is provided by the translated CN Office Action listed above #4 201880048083.8; dated Oct. 11, 2021).

Zong Wei et al., "Food processing technology with minimal destruction", Northeast Forestry University Press, Chapter 4: Active packaging and smart packaging for foods, pp. 109-111, Apr. 2006, Sep. 15, 2021 (Concise explanation of relevance is provided by the translated CN Office Action listed above #4 201880048083.8; dated Oct. 11, 2021).

Canadian Application No. 3070456 filed Aug. 13, 2018; Office Action (Requisition by Examiner) dated Feb. 9, 2022; pp. 1-8.

Japanese Office Action with english translation; International Application No. 2020-502989; International Filing Date: Jan. 21, 2020; dated Dec. 20, 2021; pp. 1-6.

(56) References Cited

OTHER PUBLICATIONS

Notification of the Second Office Action with english translation; Chinese Application No. 201880048083.8; International Filing Date: Jan. 16, 2020; dated Apr. 1, 2022; pp. 1-18.
U.S. Non-Final Office Action; U.S. Appl. No. 16/637,329, filed Feb. 7, 2020; dated May 23, 2022; pp. 1-45.
Canadian Office Action; Canadian Application No. 3,070,454; dated May 6, 2022; 5 pages.
Chinese Third Office Action; Chinese Application No. 201880047564.7; dated May 7, 2022; 11 pages.

* cited by examiner

INKLESS PRINTING ON SUBSTRATES AND COMESTIBLES

CROSS REFERENCE TO RELATED APPLICATIONS

This application is a National Stage application of PCT/US2018/046459, filed Aug. 13, 2018, which claims the benefit of U.S. Provisional Application No.: 62/545,217, filed Aug. 14, 2017, both of which are incorporated by reference in their entirety herein.

FIELD

The disclosure relates generally to marking a package or product with identifying indicium, and more particularly, to a method of marking a package using inkless printing to form identifying indicium on a desired surface.

BACKGROUND OF THE INVENTION

Within the food packaging industry, the importance of being able to provide traceability throughout the manufacturing process has recently increased. Traceability as used herein refers to the possibility of being able to trace and control for example the origin of the packaging materials, product process parameters, parameters for packaging, and filling in a packaging line. This information may be used to generate a best-before-date for the package with content. Traceability throughout the value chain facilitates quick recall of packages and the possibility of ensuring a high quality of the final product and, in the end, such offers safety for the consumer and consumer trust for the food producer. Marking of packaging is a complex process that requires additional time and customization for each product produced.

BRIEF DESCRIPTION OF EMBODIMENTS OF THE INVENTION

According to one embodiment of the invention, a method of marking a package includes providing a package including an additive transformable from a first state to a second state in response to an external stimulus and presenting said package via a sales device. At least a portion of said additive is in said first state when said package is presented in said sales device. At least a portion of said additive is activated to form identifying indicia on said package within said sales device.

In addition to one or more of the features described above, or as an alternative, in further embodiments said activating said additive to form identifying indicia on said package occurs proximate to a time said package is presented.

In addition to one or more of the features described above, or as an alternative, in further embodiments said sales device includes a laser configured to activate said additive.

In addition to one or more of the features described above, or as an alternative, in further embodiments said sales device is a vending machine.

In addition to one or more of the features described above, or as an alternative, in further embodiments activating said at least a portion of said additive includes transforming said additive from said first state to said second state.

In addition to one or more of the features described above, or as an alternative, in further embodiments transforming said additive from said first state to said second state includes applying an external stimulus to said additive.

In addition to one or more of the features described above, or as an alternative, in further embodiments said external stimulus is selected from radiation, light, and heat.

In addition to one or more of the features described above, or as an alternative, in further embodiments said identifying indicia includes an image.

In addition to one or more of the features described above, or as an alternative, in further embodiments said identifying indicia has a multi-color configuration.

These and other embodiments are described in detail below.

BRIEF DESCRIPTION OF THE DRAWINGS

The accompanying drawings incorporated in and forming a part of the specification embodies several aspects of the present disclosure and, together with the description, serves to explain the principles of the present disclosure. In the drawings.

The detailed description explains embodiments of the invention, together with advantages and features, by way of example with reference to the drawings.

DETAILED DESCRIPTION OF THE INVENTION

Figure 1A:
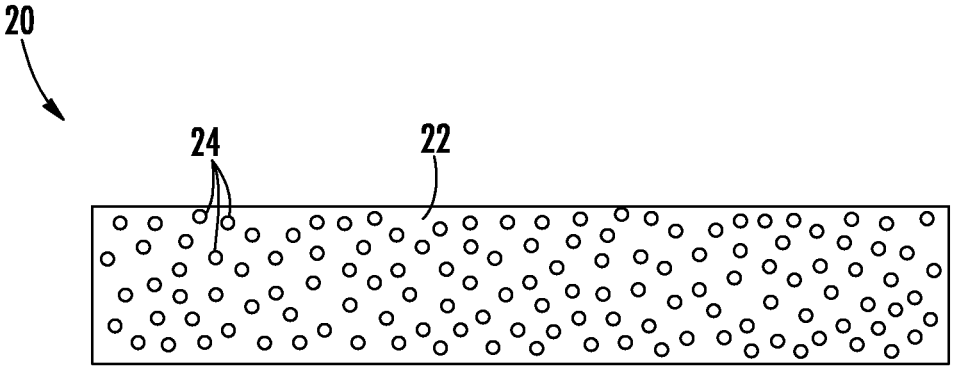
FIG. 1A is a top view of a color change composition according to an embodiment.
Figure 1B:
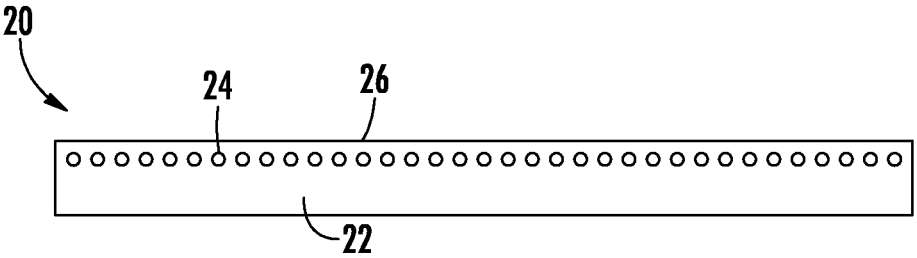
FIG. 1B is a cross-sectional view of a color change composition according to an embodiment.

A color changing composition 20 may be adapted for use in a variety of applications, including, but not limited to food or comestible applications, or packaging applications associated therewith. An example of a color changing composition 20 is illustrated in FIGS. 1A and 1B. As shown, the composition 20 typically includes a carrier material 22 and at least one component, such as an additive illustrated schematically at 24, integrated into the carrier material 22. The carrier material 22 may be white, transparent, metalized, tinted, colored, window patched, mono, duplex, or triplex. Further, the additive 24 may be integrated into the carrier material 22 via any suitable process. For example, the additive may be encapsulated, embedded, coextruded, bi-injected, die-injected, blow molded, sandwich coated, or surface or reverse applied to the carrier material 22.

In embodiments where the carrier material 22 is a liquid, the additive 24 in the form of pigment, molecules, or crystals is dispersed within the liquid. Examples of liquid carrier materials include varnish, coating, and lacquer. The additive may be integrated into conventional inks for printing, or may be used as a spot varnish that may be reactivated at a later stage. Further the liquid carrier material 22 may be tinted, non-tinted, water based, solvent, ultraviolet, or any combination thereof. In another embodiment, the carrier material may be selected from a processed material, such as resin, polymer, monomer, adhesive or starch, and the additive 24 is embedded therein. Although the additive 24 is illustrated as a plurality of particles, it should be understood that an additive in any suitable form is contemplated herein.

In an embodiment, the color changing additive 24 includes a diacetylene compound. Examples of diacetylene carboxylic acid compounds that can be used in the present invention include: 12,14-hexacosadiyndioic acid, 11,13-tetracosadiyndioic acid, 10,12-docosadiyndioic acid, 9,11-eicosadiyndioic acid, 8,10-octadecadiyndioic acid, 7,9-hexadecadiyndioic acid, 6,8-tetradecadiyndioic acid, 5,7-docosadiyndioic acid, 4,6-decadiyndioic acid, 3,5-octadiyndioic acid, 2,4-hexadiyndioic acid, 10,12-pentacosadiynoic acid, 5,7-dodecadiynoic acid, 4,6-dodecadiynoic acid, 5,7-eicosadiynoic acid 6,8-heneicosadiynoic acid, 8,10-heneicosadiynoic acid, 12,14-heptacosadiynoic acid, 2,4-heptadecadiynoic acid, 4,6-heptadecadiynoic acid, 5,7-hexadecadiynoic acid, 10,12-heneicosaadiynoic acid, 10,12-nonacosadiynoic acid, 10,12-heptacosadiynoic acid, 10,12-octadecadiynoc acid, 10,12-pentacosadiynoic acid, 10,12-tricosadiynoic acid, 6,8-nonadecadiynoic acid, 5,7-octadecadiynoic acid, 10,12-octadecadiynoic acid, 5,7-tetradecadiynoic acid, 10,12-Pentacosadiynoic acid and 10,12-docosadiyndioic acid and derivatives thereof are particularly preferred. Where the diacetylene compound is a dicarboxylic acid and derivatives thereof, it can be either symmetrical or unsymmetrical, either with respect to n and/or the alkyl chain length. Preferred diacetylenes are symmetrical about the diacetylene unit, i.e. $T{=}(CH_2)_n{-}(C{=}O)\text{-}Q^1R^1$.

Alternatively, the additive 24 may include other color change chemistries that are directly responsive to light, in particular laser light. Examples of such chemistries include metal oxyanions, particularly molybdates and borates. The additive may comprise charrable agents such as polysaccharides, carbohydrates, sugars and the like including: cellulose and derivatives thereof, glucose, saccharose, sucrose, maltodextrin, lactose, starch, dextrose and polydextrose and gums. In another embodiment, the additive may include metal salts such as sodium bicarbonate and sodium carbonate. In yet another embodiment, the additive may comprise a color forming agent such as leuco dyes and charge transfer agents. These can used in combination with a photo or thermal acid or base generating agents. Particularly preferred photoacid generating agents include "onium types" such as sulphonium or iodonium salts. Further examples of photoacid generating agents include amine adducts of aromaticsulphonic acids such as amine adducts of dinonylnaphthalene disulphoic acid and tosylates. Other acid generating 'onium' compounds include ammonium and amine: sulphate, phosphate, hydrogen phosphate, dihydrogen phosphate and borates. However, any suitable additive is contemplated herein.

The additive 24 may be located generally adjacent a surface of the carrier material 22, such as an exposed upper surface 26 of the carrier material 22 for example, as shown in FIG. 1B, or alternatively, may be distributed through the entire thickness of the carrier material 22, such as in a homogeneous manner for example. Although only a single additive is illustrated in the FIGS., it should be understood that a plurality of different types of additives may be formed into a single color changing composition 20. Further, in such embodiments, the colors associated with each of the plurality of additives may be the same or different in each of a first state and a second state.

The additive 24 is susceptible to transformation between a first state and a second state. The additive 24 typically has a first color in the first state and a second color in the second state, the second color being distinct from the first color. Further, it should be understood that in either the first state or the second state, the additive 24 may be colorless, transparent, or the same color as the surrounding carrier material 22. It should be understood that the color changing composition 20 may additionally include other components, such as pigments or colored materials for example, that remain in a constant state.

The color changing composition 20 may be used in processes such as inkless printing, which is on-demand energized image generation without the application of added material. In an embodiment, the at least one additive 24 in the color changing composition 20 is configured to transform between the first state and the second state, i.e. change color, in response to the application of energy thereto, such as upon irradiation with light, including infrared light or light within either the visible or ultraviolet spectrum. Alternatively, the additive 24 may be configured to change color when energized by, for example, other types of electromagnetic radiation, or an electron beam. In conventional color changing compositions, the one or more additives 24 are typically colorless or transparent prior to being energized and change color to one of a plurality of colors when energized depending on one or more parameters of the incident energy applied thereto and the carrier material. It should be understood that the color changing composition 20 illustrated and described herein is intended as an example only, and any type of color changing composition transformable between a first state and a second state is considered within the scope of the disclosure.

Figure 2:
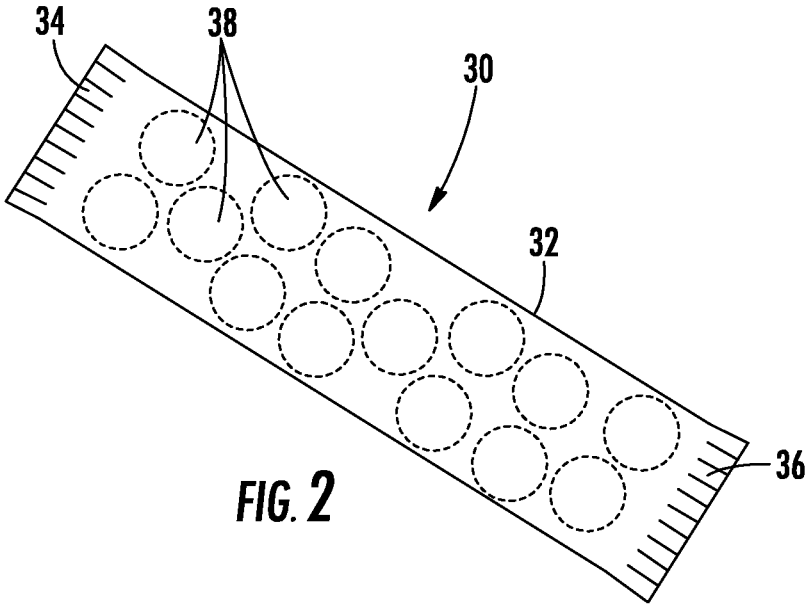
FIG. 2 is a perspective view of a package according to an embodiment.

With reference now to FIG. 2, an example of a package 30 configured to enclose one or more food items, such as a comestible or confectionery for example, is shown. In the illustrated, non-limiting embodiment, the package 30 is used to contain and/or dispense one or more product pieces, such as pieces of confection contained in loose orientation within the package 30. The pieces of confection, illustrated in broken lines at 38, may be any size, shape, or configuration. While described with reference to a plurality of pieces of confection, it is contemplated that the package 30 may contain one or more products having portions thereof that can be broken away or detached for use.

As shown, the package 30 includes a generally elongate tubular body 32 which may be formed from a thin-film flexible material, such as polypropylene for example. However, a rigid material is also within the scope of the disclosure. The package 30 includes opposed ends 34 and 36 which are sealed closed. Various conventional techniques are known for sealably closing the ends 34 and 36 of package 30. These techniques may include crimp-sealing the ends, as well as heat-sealing the ends. The seals are such that they hermetically seal the package, thereby protecting the pieces of confection 38 contained therein during shipping and prior to use. To open the package and dispense the one or more pieces of confection 38 contained therein, one of the ends 34, 36 may be detached from the body 32 to form an open end. It should be understood that the package 30 illustrated and described herein is intended as an example only, and any type of package having any shape and formed from any material operable to substantially enclose one or more food items is contemplated herein.

In an embodiment, at least a portion of the package 30 includes a color changing composition 20 visible at an exterior of the package 30. All or a portion of the color changing composition 20 may be transformed between the first and second state to provide information, such as regarding the package 30 or the contents thereof for example. The color changing composition 20 may be transformed between the first state and second state at any of a variety of locations or stages during a packaging or dispensing process. In an embodiment, all or a portion of the color changing composition 20 may be transformed from a first state to a second state during the packaging of one or more items. Alternatively, all or a portion of the color changing composition 20 may be transformed from a first state to a second state within a dispensing or vending process. Embodiments where various portions of the color changing composition 20 are changed at different stages within the same process, or within different processes, such as the packaging and dispensing processes are also within the scope of the disclosure. For example, in an embodiment, a first portion of the color changing composition 20 is transformed within the packaging process to generate first piece of information, such as a use by date associated with the package, and a second portion of the color changing composition 20 is transformed within the dispensing process to provide a second piece of information, such as to indicate the date that the package was purchased.

The information, also referred to herein as indicia, may be generated, via application of energy to the color changing composition 20, to form any identifying feature such as letters, numbers, characters or symbols, or an image and markings for example. It should be understood that the application of heat and/or energy may be controlled and/or manipulated to generate the desired indicia. Alternatively, the additive 24 may be embedded within the packaging 30 in a desired shape representative of one or more pieces of information. In such embodiments, the indicium is generated simply upon the application of heat and/or energy over the entire area of the composition 20 including the additive 24. Further, the information generated may comprise a single color, or alternatively, may comprise a plurality of colors distinguishable from the adjacent surface of the package 30.

Figure 3:
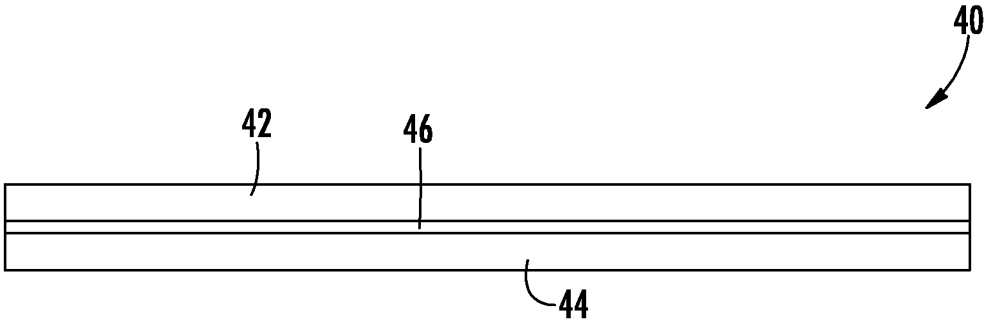
FIG. 3 is a cross-sectional view of a packaging material according to an embodiment.

The color changing composition 20 may be a separate component, such as a film or tape for example, applied over an exterior surface of the package 30. Alternatively, the color changing composition 20 may be integrated into the material of the package 30. For example, FIG. 3 illustrates a cross-sectional view of a portion of the material 40 of the package 30. As shown, the material of the package 30, illustrated schematically at 40, includes a plurality of layers arranged in an overlapping configuration. In the illustrated, non-limiting embodiment, the plurality of layers of the packing material 40 includes a first layer 42, for example located generally adjacent an exterior of the package 30, a second layer 44 located adjacent the first layer 42, such as generally adjacent an interior of the package 30, and an intermediate layer 46 interposed between the first and second layers 42, 44. In an embodiment, the intermediate layer 46 includes an adhesive material. The plurality of layers illustrated and described herein is intended as an example, and a packaging material 40 having any number of layers greater than one within the scope of the disclosure.

The first and second layers 42, 44 may be polymeric layers formed from the same material or from different materials, and the intermediate adhesive layer 46 may include a laminating adhesive, such as a solvent-less, a solvent based, or a water-based laminating adhesive for example. Examples of suitable lancinating adhesives include but are not limited to a polyether urethane adhesive, a polyester adhesive, a polyester urethane adhesive, and an acrylic adhesive. However, the intermediate layer 46 may also be formed from a polymeric material. In an embodiment, adhesive layer 46 may be configured as a color changing composition 20, such as by using the adhesive layer 46 as the carrier material 22 and incorporating an additive 24 configured to transform between a first and second state into the adhesive layer 46 for example. Accordingly, application of radiation, heat or other kinds of energy to cure the adhesive layer 46 may cause all or a portion of the additive 24 to transform between a first state and a second state. Although the color changing composition 20 is described as being integrated into the adhesive layer 46, it should be understood that the color changing composition 20 may be formed in any of the plurality of layers of the material 40.

In an embodiment, the additive 24 is integrated into one of the layers 42, 44, 46 of the packaging material 40 such that the level of migration of the additive 24 towards and into contact with the product 38 within the package 30 is less than a desired threshold, such as less than or equal to 10 ppb. In an embodiment, the level of migration is achieved by maintaining a distance or clearance 47 between the product 38 and the adjacent packaging material including the additive 24. The particles of additive 24 cannot diffuse through the air within the gap to contact the products 38. In another embodiment, a layer of material may be disposed between the additive particles 24 and the products 38. The layer of material may be any suitable material capable of limiting migration of the particles to below the desired threshold. However, the layer of material need not restrict all migration of the additive 24. In an embodiment, the layer of material includes a paper or plastic that forms a wrapper about the product 38. Alternatively, or in addition, the paper may be integrated into the packaging material 40 at a position between the additive 24 and the product 38.

In another embodiment, at least one barrier layer is positioned between the color changing composition. 20 and the one or more food items contained within the package 30. In the non-limiting embodiment of FIG. 3, the second layer 44 may be configured as the barrier layer. However, any layer within the material 40, regardless of whether that layer is directly adjacent the color changing composition 20 may be configured as the barrier layer. In an embodiment, the color changing additive 24 may be embedded directly within the barrier layer, for example by blending the additive 24 with the barrier material and then subsequently creating a layer from the blend. In such embodiments, the additive 24 may be formed in only a portion of a thickness of the carrier material 22, such that the portion of the barrier material between the additive 24 and the product functions as the barrier layer. Alternatively, the barrier layer may be a separate component, such as a film or tape for example, applied over an interior surface of the package 30.

The at least one barrier layer is intended to hinder i.e. completely restrict diffusion of any of the normally mobile chemicals in the additives 24 of the color changing composition 20. By including a barrier layer between the layer including the additive 24 and the product within the package 30, the internal surface of the package 30 is allowed to directly contact the consumable item contained therein, thereby allowing increased. flexibility in the overall shape and materials used to form the package 30. Examples of suitable materials for use in the barrier layer include, but are not limited to, aluminum, aluminum oxide, silicon oxide, polyvinylidene chloride (PVdC), ethylene vinyl alcohol, polyamide, polyethylene terephthalate, polyethylene, polypropylene, ethylene vinyl acetate, poly ethylene methyl methacrylate, poly ethylene acrylic acid, poly ethylene methacrylate, polyvinyl alcohol, ionomer, acrylics, coatings containing layered silicates.

Figure 4:
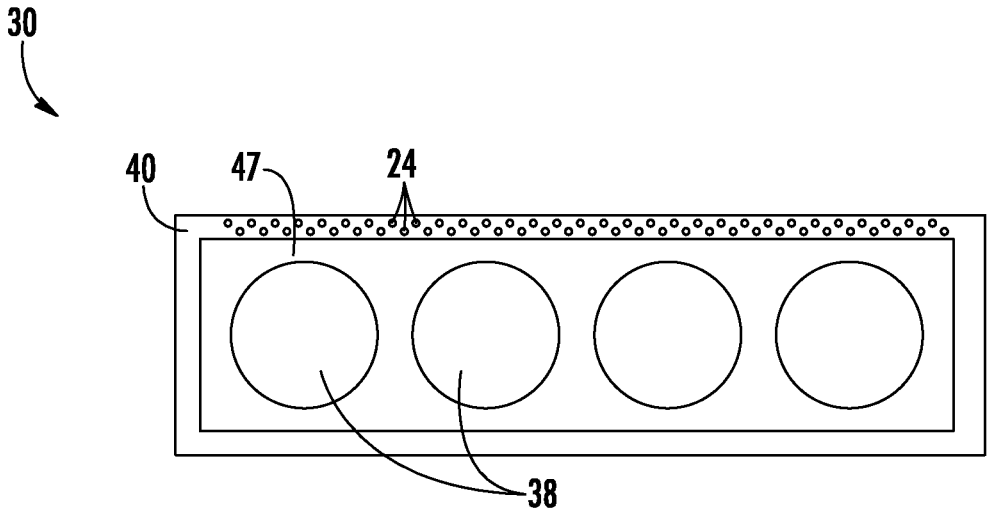
FIG. 4 is a cross-sectional view of a package according to another embodiment.
Figure 5:
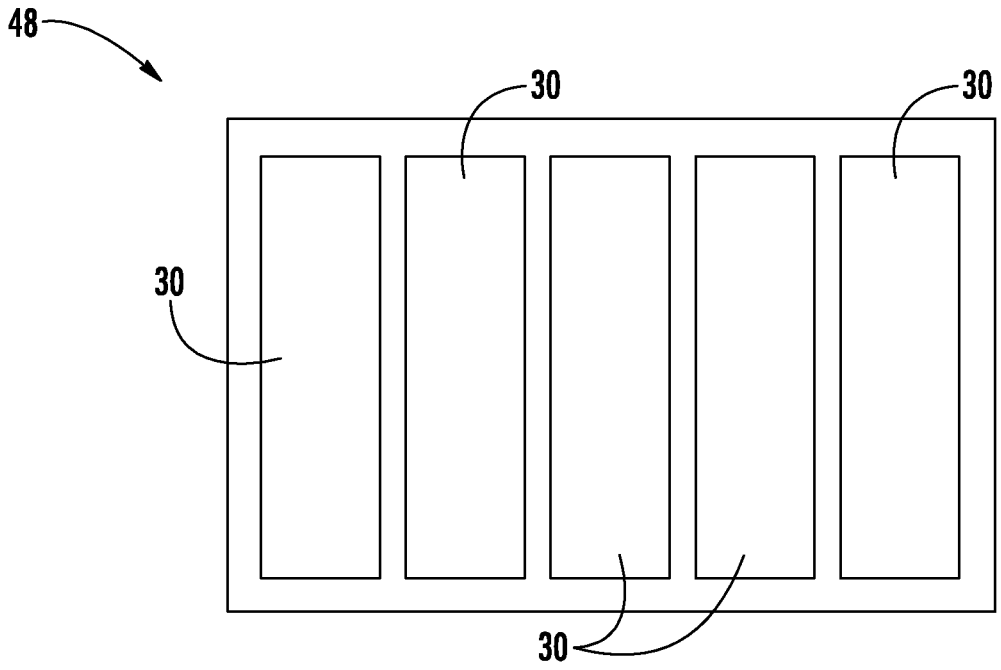
FIG. 5 is a cross-sectional view of a package according to an embodiment.

In another application, illustrated in FIG. 4, a plurality of packages 30 containing one or more food items may be arranged, such as within a hollow interior of a secondary, outer package 48. The outer package 48 is configured to retain the plurality of inner packages 30 together during the sale thereof. At least a portion of the outer package 48 includes a color changing composition 20 visible at an exterior of the outer package 48. As previously described, a portion of the color changing material 20 may be transformed between the first and second state to provide information regarding the package 48 and/or the contents thereof. The information may be generated, via application of heat or energy to the color changing composition 20, to form any identifying feature such as letters, numbers, characters or symbols, or an image for example, and may include one or more distinct colors. In such embodiments, the inner packages 30 may, but need not, include a color changing composition 20 formed therein. In addition, in an embodiment where the color changing composition 20 is applied to the outer packaging 48, the packaging material 40 of the inner packages 30, disposed between the additive 24 of the color changing composition 20 of the outer package 48 and the products contained within the inner packages 30, functions as the barrier layer to protect the products from contamination.

Figure 6A:
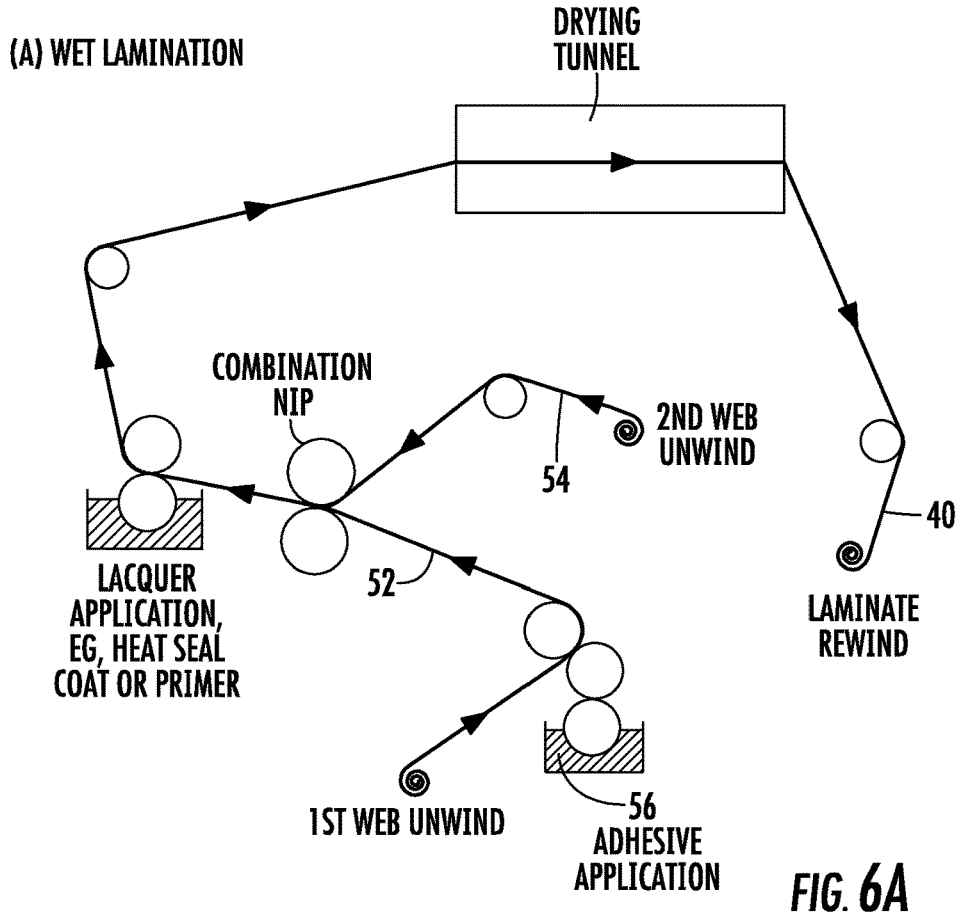
FIGS. 6A and 6B are schematic diagrams of wet and dry adhesive lamination systems according to an embodiment.
Figure 6B:
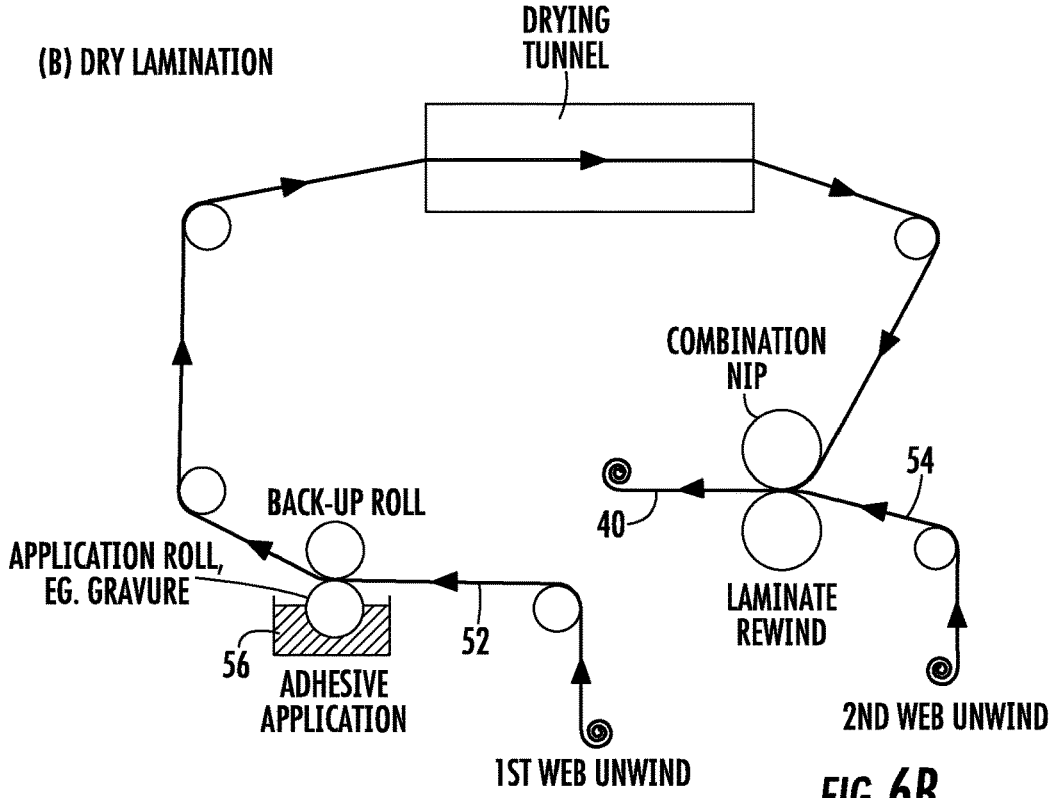
Figure 7:
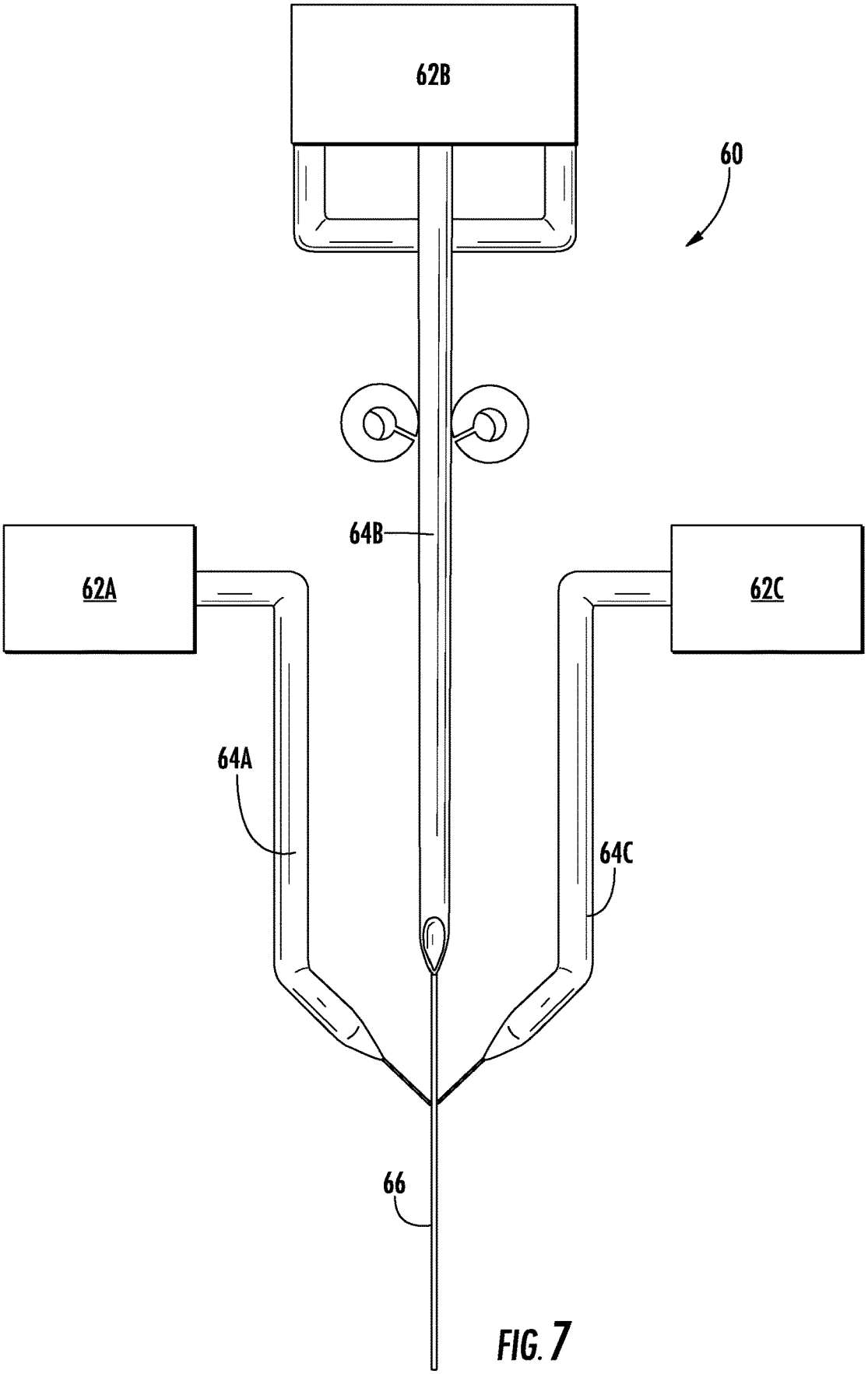
FIG. 7 is a schematic diagram of coextrusion die for manufacturing a multilayer packaging material according to an embodiment.

With reference now to FIGS. 6-8, as previously described, the color changing composition 20 may be integrated into a packaging material 40. In embodiments where the packaging material 40 has a multilayer construction, the plurality of layers may be formed separately or in unison via any suitable process. Examples of suitable manufacturing processes including, but are not limited to, adhesive lamination, extrusion coating, or extrusion lamination for example. With reference to FIGS. 6A and 6B, examples of systems for forming a packaging material 40 via adhesive lamination is shown. In the illustrated, non-limiting embodiment, the packaging material 40 includes a first layer 52 and a second layer 54. However, as previously stated, a packaging material 40 having any number of layers is within the scope of the disclosure. Further, one of the layers 52, 54 of the packaging material 40 includes the color changing additive 24. The first layer 52 and the second layer 54 are formed individually, such as via an extrusion process for example. The formed layers 52, 54 are then laminated to one another to form the packaging material 40. . This lamination may occur via either a "Wet" adhesive lamination process (FIG. 6A) or a "Dry" adhesive lamination process (FIG. 6B). In either system, an adhesive material or coating 56 is applied to one of the layers of material prior to being combined with another layer or material. The adhesive may be wet or dry when the adjacent layers are combined.

Alternatively, the packaging material 40 may be formed via a coextrusion process. With reference to FIG. 7, a coextrusion system 60 may include a plurality of distinct extruders, such as a first extruder 62*a* for extruding the first layer 52, a second extruder 62*b* for extruding the second layer 54, and a third extruder 62*c* for extruding a third layer 56. As shown in the FIG., a die of each extruder 62*a*-62*c*, forms an extrudate 64*a*-64*c* having a desired shape. As the extrudate 64 passes through the dies, the relative configuration of the dies causes the extrudate to adjoin one another in a desired manner. As a result, the layers of the packaging material 40 are expelled from the system 60 in unison and as a single body 66.

Figure 8A:
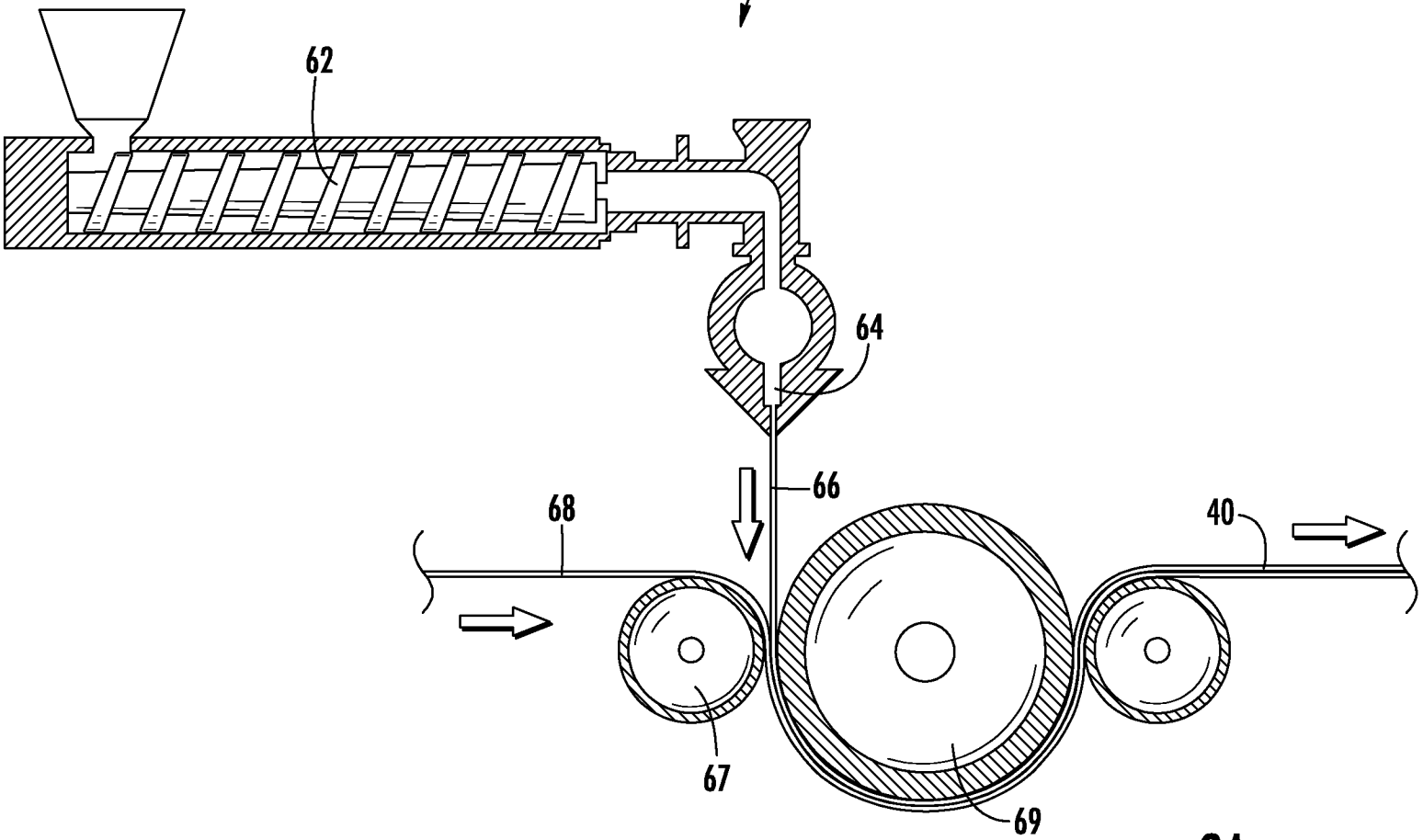
FIG. 8A is a schematic diagram of extrusion coating system for manufacturing a multilayer packaging material according to an embodiment.

In an extrusion coating process, as shown in FIG. 8A, the extrudate 66, such as a color changing composition 20, output from an extruder, or alternatively from a coextrusion system 60, may be adhered to a single layer of substrate or film 68. An adhesive, such as in the form of a coating or another layer for example, is applied to the substrate 68 to couple the extrudate 66 to the substrate 68. The extrudate 66 and the film 68 may be supplied to a gap, such as formed between a pair of rollers 67, 69, where they are laminated causing the extrudate 66 to adhere to the substrate 68.

Figure 8B:
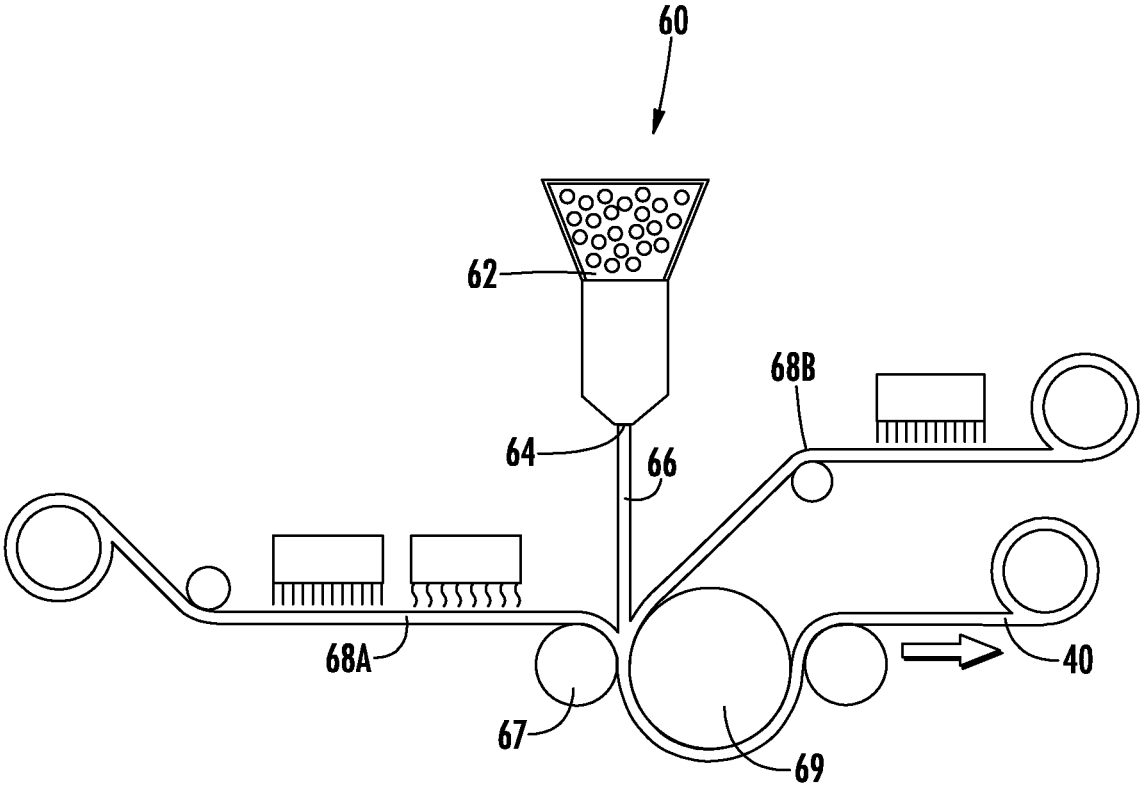
FIG. 8B is a schematic diagram of extrusion lamination system for manufacturing a multilayer packaging material according to an embodiment.

Similar to extrusion coating, in an extrusion lamination process, a secondary substrate of film 68 having an adhesive material disposed thereon is also applied to the opposite side of the extrudate 66. As shown in FIG. 8B, each of the substrates 68*a*, 68*b*, and the extrudate 66 is supplied to the gap between the rollers 67, 69. The rollers 67, 69 move the substrates 68*a*, 68*b* into contact with the major surfaces of the extrudate 66 to form a multilayered material. Regardless of whether the packaging material 40 is coextruded, or formed via adhesive lamination, one of the plurality of layers has the at least one additive 24 included therein. The layer containing the additive 24 may be a polymeric layer. Examples of materials suitable for the polymeric layer include, but are not limited to polyamide, polyethylene terephthalate, polyethylene, polypropylene, ethylene vinyl acetate, poly ethylene methyl methacrylate, poly ethylene acrylic acid, poly ethylene methacrylate, polyvinyl alcohol, ionomer or combinations thereof.

Figure 9:
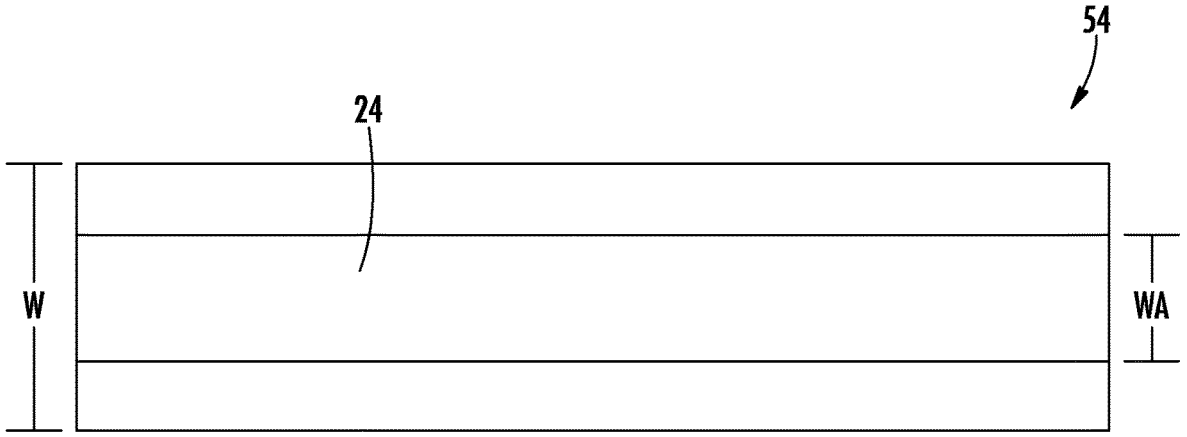
FIG. 9 is a top view of a layer of a packaging material including a color changing additive according to an embodiment.
Figure 10:
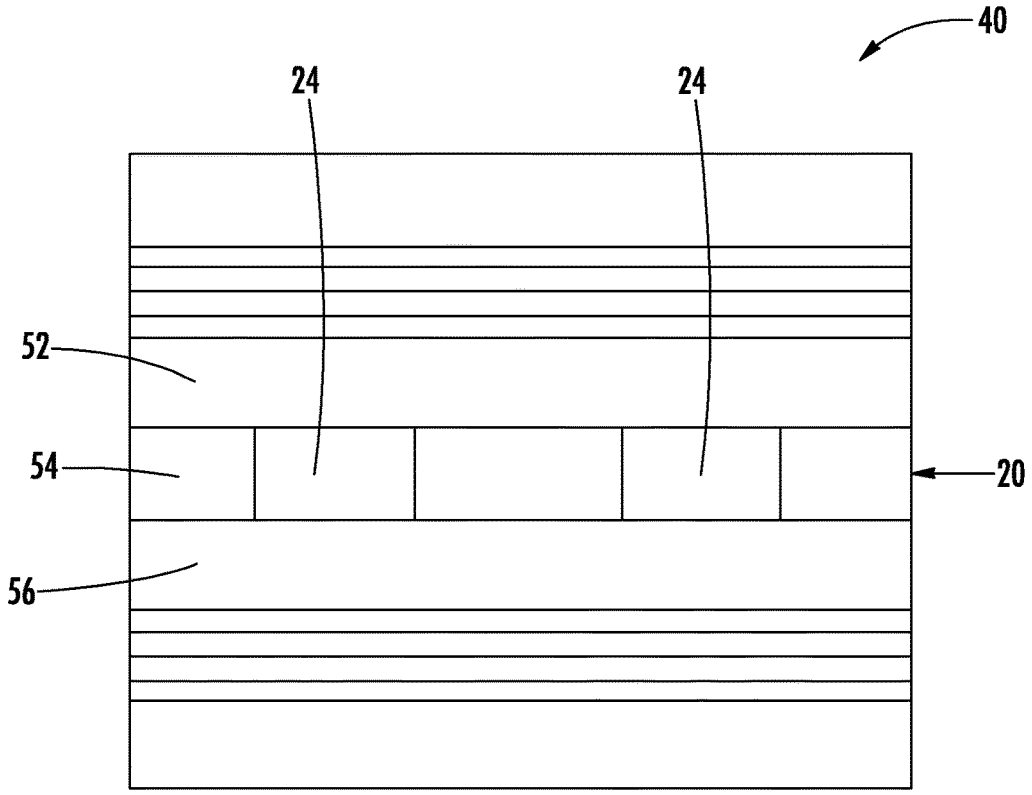
FIG. 10 is a cross-sectional view of a packaging material taken in a plane perpendicular to a machine direction according to an embodiment.

In an embodiment, best shown in FIGS. 9 and 10, the positioning of the additive 24 within a layer, such as layer 54 for example, may be controlled. For example, the layer 54 may be extruded from an extruder die having a desired width W; however, a width Wa of the additive 24 may be equal to only a portion of the width of the layer. In an embodiment, the additive 24 may be arranged within the layer 54 to form a band or strip extending parallel to the machine direction, i.e. the direction of movement of the layer through the extruder die. In another embodiment, the additive 24 may be arranged in a pattern across one or more portions of the layer 54. However, any suitable configuration where the positioning of the additive 24 is controlled (i.e. the additive does not extend through the entirety of a corresponding layer or carrier material) is contemplated herein.

Figure 11:
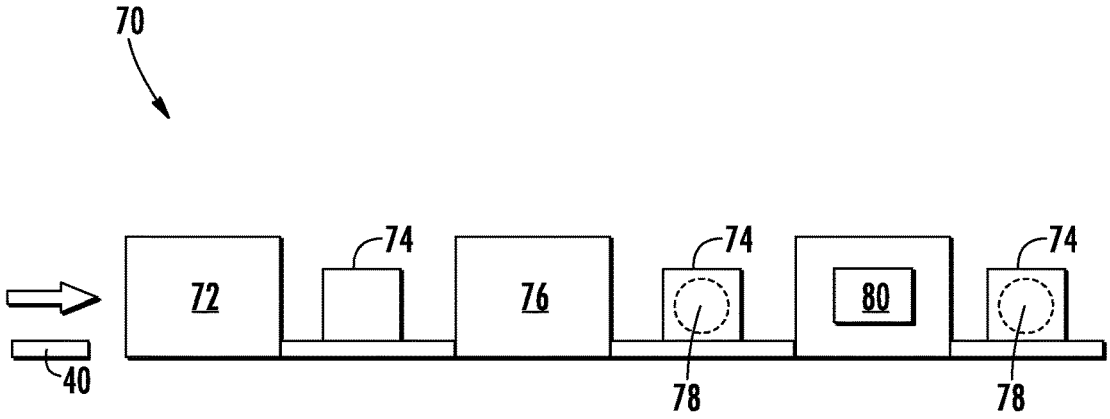
FIG. 11 is a schematic diagram of a packaging system for forming a package according to an embodiment.

When the packaging material 40 including a color changing composition 20 is used to form a package, such as package 30 or package 48 for example, the material 40 is typically provided to a packaging system with at least a portion of the color changing composition being in a first state. In the first state, the additive 24 is typically colorless, transparent, or may be the same color as the adjacent material. As a result, the additive 24 within the packaging material 40 in the first state does not provide any markings or identifying indicia. An example of a packaging line or system 70 is illustrated in FIG. 11. As shown, the packaging system 70 typically includes a first system 72 configured to receive a piece of packaging material 40 for forming into a desired shape. The desired shape is typically the form of a package or container, illustrated at 74, such as having a generally hollow interior for example, within which one or more items may be located.

Downstream from the first system 72 is a second system 76 configured to position one or more food items, illustrated schematically at 78, within the hollow interior of the package 74. After installing the items 78 to be contained within the package 74, the package 74 is provided to a third system 80 where the package 74 is sealed to retain the items therein. In an embodiment, the first, second and third systems 72, 76, 80 are arranged to form a continuous packaging line 70. Although the first, second, and third systems 72, 76, 80 are illustrated and described herein as distinct systems, embodiments where two or more of the systems are integrated are also contemplated herein. Further, it should be understood that forming the packaging material into a package, positioning one or more contents within the package, and sealing all or a portion of the package may occur within the packaging line 70 in any order. In an embodiment, the packaging system 70 includes one of a vertical form-fill seal machine, a horizontal form-fill-seal machine, or a thermoform fill-seal-machine.

In an embodiment, the at least one additive 24 is transformed from the first state to the second state within the packaging system 70 to form indicia or other identifying marks or images on the package 74. The indicia are formed by applying radiation or a heat pattern, such as generated by a laser for example. The laser may have a digital interface including a module containing information associated with the indicia to be formed. In an embodiment, energy is applied to the additive 24 within the packaging material 40 being formed into a package 74 having a desired shape. The forming of the indicia may occur either prior to or after the package 74 is filled with one or more items 78. In an embodiment, the indicia may be formed after the package 74 is sealed to contain the items 78 therein. By applying the indicia to each package 74 during the packaging process via transformation of an additive 24 associated with the packaging material 40, the indicia may be easily varied between packages.

Figure 12:
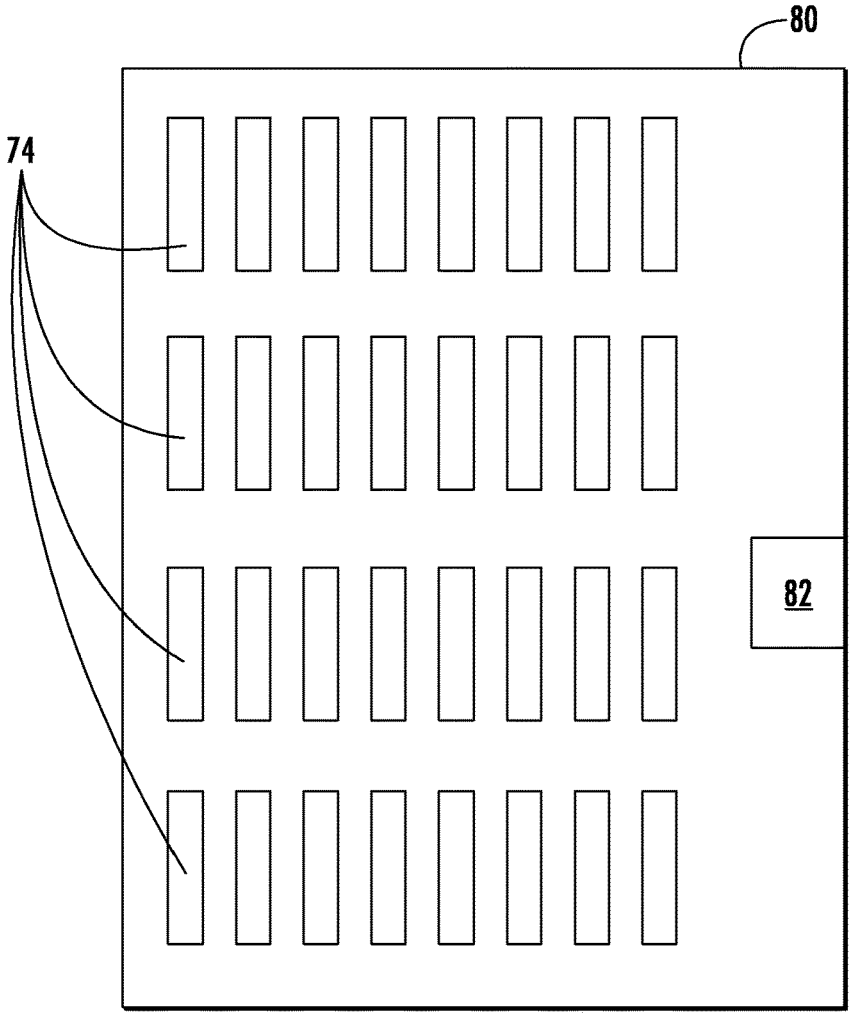
FIG. 12 is a front view of a sales device for use with a package including a color change composition according to an embodiment.

Referring now to FIG. 12, in another embodiment, the indicia created by transforming the additive from a first state to a second state is generated just before the package 74 is delivered to a user for consumption, such as via a sales device 80. In such embodiments, the packaging material 40 including a color changing additive 24 is formed, filled, and sealed in a known manner without energizing the additive 24 and causing a transformation between the first state and the second state. In an embodiment, the package 74 may be stored within the sales device 80, for example a vending machine, in a known manner. Upon installation of the package 74 into the vending machine, or alternatively, upon removal of the package 74 from the vending machine via a purchase of the package, the color changing additive 24 may be transformed from the first state to the second state. In an embodiment, an energy radiation device 82, such as a laser for example, is integrated into the vending machine 80 and is selectively applicable to the package. In an embodiment, the package 74 contained within the vending machine may have one or more identifying marks, such as a bar code for example, formed thereon. However, the laser may be applied to transform the additive to the second state to indicate that the package has been purchased or to track the usage of the packages within the machine.

A package including a color changing composition 20 as illustrated and described herein has the added benefits of providing flexibility in when and how the package is marked with identifying indicia. Accordingly, a generic film or other color changing composition may be adapted for use with multiple types of products, and product specific information may be generated via a machine. Through such a process, product specific information, and even information specific to each individual unit produced may be added to a package. The use of a generic film simplifies inventory by eliminating product specific packaging films, and further increases efficiency by eliminating downtime for changeover of the system between products. As a result, the total amount of waste associated with a packaging and marking process is reduced.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A method of marking packaging comprising:

providing a package enclosing one or more food items, said package being formed of a packaging material, wherein an additive transformable from a first state to a second state in response to an external stimulus is integrated into a layer of said packaging material;

presenting said package via a sales device, wherein at least a portion of said additive is present and in said first state when said package is initially provided to said sales device;

activating said at least a portion of said additive integrated into the material of the package via heat and/or energy while the package is within said sales device;

manipulating said heat and/or energy in the sales device to generate desired indicia formed by said activating of said additive while the package is in said sales device, wherein activating said at least a portion of said additive includes transforming said additive from said first state to said second state, and wherein transforming said additive from said first state to said second state includes applying the heat and/or energy to said additive.

2. The method of claim 1, wherein said activating said additive to form identifying indicia on said package occurs proximate to a time said package is presented.

3. The method of claim 1, wherein said sales device includes a laser configured to activate said additive.

4. The method of claim 1, wherein said sales device is a vending machine.

5. The packaging material of claim 1, wherein said identifying indicia includes an image.

6. The packaging material of claim 1, wherein said identifying indicia has a multi-color configuration.

7. The method of claim 1, further including sealing said package including said additive.

8. The method of claim 1, wherein said additive is integrated in said packaging material in a desired shape representative of one or more pieces of information when said package is initially presented to said sales device.

* * * * *